US006777600B2

(12) United States Patent
Daring

(10) Patent No.: US 6,777,600 B2
(45) Date of Patent: Aug. 17, 2004

(54) BOWED STRING INSTRUMENT TEACHING DEVICE

(76) Inventor: Chris A. Daring, 6551 Zinnia St., Arvada, CO (US) 80004

( * ) Notice: Subject to any disclaimer, the term of this patent is extended or adjusted under 35 U.S.C. 154(b) by 0 days.

(21) Appl. No.: 10/331,094

(22) Filed: Dec. 26, 2002

(65) Prior Publication Data

US 2004/0123719 A1 Jul. 1, 2004

(51) Int. Cl.[7] ..... G10D 1/02

(52) U.S. Cl. ..... 84/281; 84/282; 84/283; 84/453; 84/468; 84/274

(58) Field of Search ..... 84/281, 282, 283, 84/274, 453, 468

(56) References Cited

U.S. PATENT DOCUMENTS 1,897,225 A * 2/1933 Archer ..... 84/282
2,452,396 A * 10/1948 Shopmaker ..... 84/282
3,656,187 A * 4/1972 Katz ..... 623/65

* cited by examiner

*Primary Examiner*—Shih-Yung Hsieh
(74) *Attorney, Agent, or Firm*—Merchant & Gould P.C.

(57) ABSTRACT

A teaching device for bowed string instruments includes a base connected to a finger support by a stem. The base is used to attach the teaching device to a bow for a bowed string instrument. The base has an outer end and an inner end and a central opening therebetween that receives the bow. The central opening has a longitudinal axis that is parallel to the longitudinal axis of the bow when the base is attached to the bow. The finger support has hollow body with a closed lower end and an open upper end and a central cavity between the two ends. The central cavity has a longitudinal axis that is positioned at an angle of less than 90° to the longitudinal axis of the base. The player's little finger is positioned within the central cavity of the finger support, which forces the little finger into an angled position with respect to the bow and teaches a player how to maintain a proper grip on the bow.

21 Claims, 8 Drawing Sheets

BOWED STRING INSTRUMENT TEACHING DEVICE

BACKGROUND OF THE INVENTION

The present invention relates to bowed string instruments and more particularly concerns a teaching device for teaching players of these instruments how to properly grip a bow when playing a bowed string instrument.

Bowed string instruments, such as violins, violas, cellos, and fiddles, comprise an instrument with one or more strings and a separate bow that is used create noise from the strings. By way of example only, the following background is directed to a violin. As shown in FIG. 1, the violin 10 comprises a substantially hollow body 12, a substantially solid arm 14 connected to the body 12, a fingerboard 15, and a set of strings 16. The body 12 has an end 18 distal to the arm 14 and the arm has an end 20 distal to the body 12, wherein the distal end 18 of the body 12 and the distal end 20 of the arm 14 form opposite ends of the instrument. The fingerboard 15 runs substantially the entire length of the arm 14 and extends beyond the arm 14 to cover approximately half of the body 12. The strings 16 have two ends, 22 and 24, wherein the ends 22 are attached near the distal end 18 of the body 12 and the opposite ends 24 are attached near the distal end 20 of the arm 14, such that the strings 16 run almost the entire length of the instrument 10. A bridge 28 is attached to the body 12 between the point where the ends 22 of the strings 16 are attached to the body 12 and the fingerboard 15, such that the strings 16 run over the bridge 28. An aperture 32 in the body 12 is positioned between the bridge 28 and the fingerboard 15 such that the strings 16 run over the aperture 32. A chin rest 26 is attached to the distal end 18 of the body 12 near the point where the strings 16 are attached.

As best shown in FIG. 5, a bow 50 has first and second ends 54 and 56 having a longitudinal axis 55 therebetween, wherein the end 56 is bent at an angle to form a tip 58. A screw 60 is attached at the end 54, a metal slide 62 is positioned adjacent the screw 60, a grip 64 is positioned adjacent the slide 62, and a stick 52 is positioned adjacent to the grip 64 and extends the remaining length of the bow 50 to the tip 58. A frog 66 is attached near the end 54 of the bow 50 opposite the tip 58 and is positioned in a substantially parallel relation to the tip 58. The frog 66 has a generally rectangular shape having two opposite surfaces 67 defined by an outer edge 68 proximal the screw 60, an inner edge 70 opposite the outer edge 68, an upper edge 72 attached directly to the slide 62, and a lower edge 74 opposite the upper edge 72. The frog 66 further includes an arm 76 that is located at the corner formed by the inner edge 70 and the upper edge 72, such that the arm 76 is connected to the slide 62. A ferrule 78 is attached to the corner of the frog 66 formed by the lower edge 74 and the inner edge 70. An eye 80 is positioned on the surface 67 of the frog 66. Finally, bow hair 82 is stretched between the ferrule 78 and the tip 58. The bow hair 82 may be made of horsehair or other synthetic material. The screw 60 is attached to the frog 66 so that turning the screw 60 will tighten or loosen the tension on the bow hair 82.

A player plays a bowed string instrument, such as a violin, as generally shown in FIG. 1. The player's right hand grips the bow 50 near the end 54 about the slide 62, the grip 64, and the frog 66. The player's left hand grips the distal end 20 of the arm 14 of the violin 10 such that the player's fingers may press the strings 16 against the fingerboard 15 on the arm 14. The player uses the chin rest 26 to support the distal end 18 of the body 12 of the violin 10 between his or her chin and shoulder. The player moves the bow hair 82 of the bow 50 in a straight line across the strings 16 (i.e., perpendicular to the strings 16) between the bridge 28 and the fingerboard 15. A straight path is essential because it produces the clearest tone and enables the player to execute fast passages. The straight path is achieved by properly gripping the bow 50 so that the wrist leads the bow 50 across the strings 16. In this way, the wrist acts like a pendulum to cause the bow 50 to move back and forth along an identical path.

A proper grip is shown in FIG. 1. Specifically, the player's wrist should be positioned above frog 66 with the little finger resting on the slide 62 at an angle to the bow 50. The player's middle and ring fingers should rest on the surface 67 of the frog 66 and the player's index finger should rest on the grip 64. The player's thumb should rest of the surface 67 of the frog 66 opposite the surface 67 touched by the middle and ring fingers. The player should use his or her wrist to lead the bow 50 and should grip the bow 50 such that the stick 52 is tilted slightly toward the fingerboard 15. Keeping the wrist above the frog 66 allows the bow 50 to travel in a straight line across the strings 16, i.e. perpendicular to the strings 16.

However, it is often difficult for new players of bowed string instruments, such as violins or cellos, to learn how to properly grip the bow 50 such that the wrist, and not the hand, leads the bow 50 across the strings 16. Part of the difficulty in learning how to properly grip a bow 50 results from the fact that the proper grip goes against a person's natural tendencies for movement. That is, the natural tendency is for people to use their hands, and not their wrists, to move objects. For this reason, new players naturally grip the bow 50 with their wrist positioned at the same level or lower than frog 66, as shown in FIGS. 2 and 3, which allows them to lead the bow 50 with their hand. But leading the bow 50 with the hand causes the bow 50 to travel across the strings 16 in an angled (i.e., not perpendicular) position, which adversely affects the tone and sound. Additionally, because the hand has a much greater range of motion than the wrist, the angled path of the bow 50 tends to change every time the bow 50 passes back and forth. This is not desired. An improper grip also makes it difficult for players to exert the right amount of pressure on the strings 16. That is, too much pressure makes it difficult to move the bow 50 across the strings 16 and too little pressure will not produce enough sound. Further, even if the player begins with the proper grip, it is very difficult for them to maintain the proper grip as they move the bow 50 back and forth across the strings 16. Again, this occurs because new players will lapse into the more natural improper grip as they concentrate on moving the fingers of their left hand over the strings 16 and on reading sheet music.

Accordingly, a bowed string instrument teaching device solving the aforementioned and other problems is desired.

SUMMARY OF THE INVENTION

Against this backdrop the present invention has been developed to solve the above and other problems by using a teaching device attached to the bow.

The teaching device for bowed string instruments includes a hollow tubular base having an outer end and an inner end and an internal surface between these ends. The internal surface of the base defines a central opening that receives the bow to provide a secure attachment of the base to the bow. The base has a longitudinal axis between the outer end and the inner end that is parallel to the longitudinal axis of the bow when the base is attached to the bow. A finger support is connected to the base by a stem. The finger support has a closed lower end and an open upper end and a central cavity between the two ends. The finger support has a longitudinal axis that is positioned at an angle of less than 90° to the longitudinal axis of the base. The player's little finger is positioned within the central cavity of the finger support, which forces the little finger into an angled position with respect to the bow and teaches a player how to maintain a proper grip on the bow.

The teaching device may be attached to the bow in a number of ways. For example, the base of the teaching device may be slidably attached to the bow. Alternatively, the base may include a longitudinal slot that extends from the outer end to the inner end of the base so that bow may be inserted into the central opening of the base through the slot. In another embodiment, the base may be formed integrally with the bow.

These and various other features as well as advantages which characterize the present invention will be apparent from a reading of the following detailed description and a review of the associated drawings.

DETAILED DESCRIPTION

FIGS. 4–8 show a preferred embodiment of the present invention comprising a teaching device 100 having a finger support 130 connected to a base 102 by a stem 160.

Figure 1:
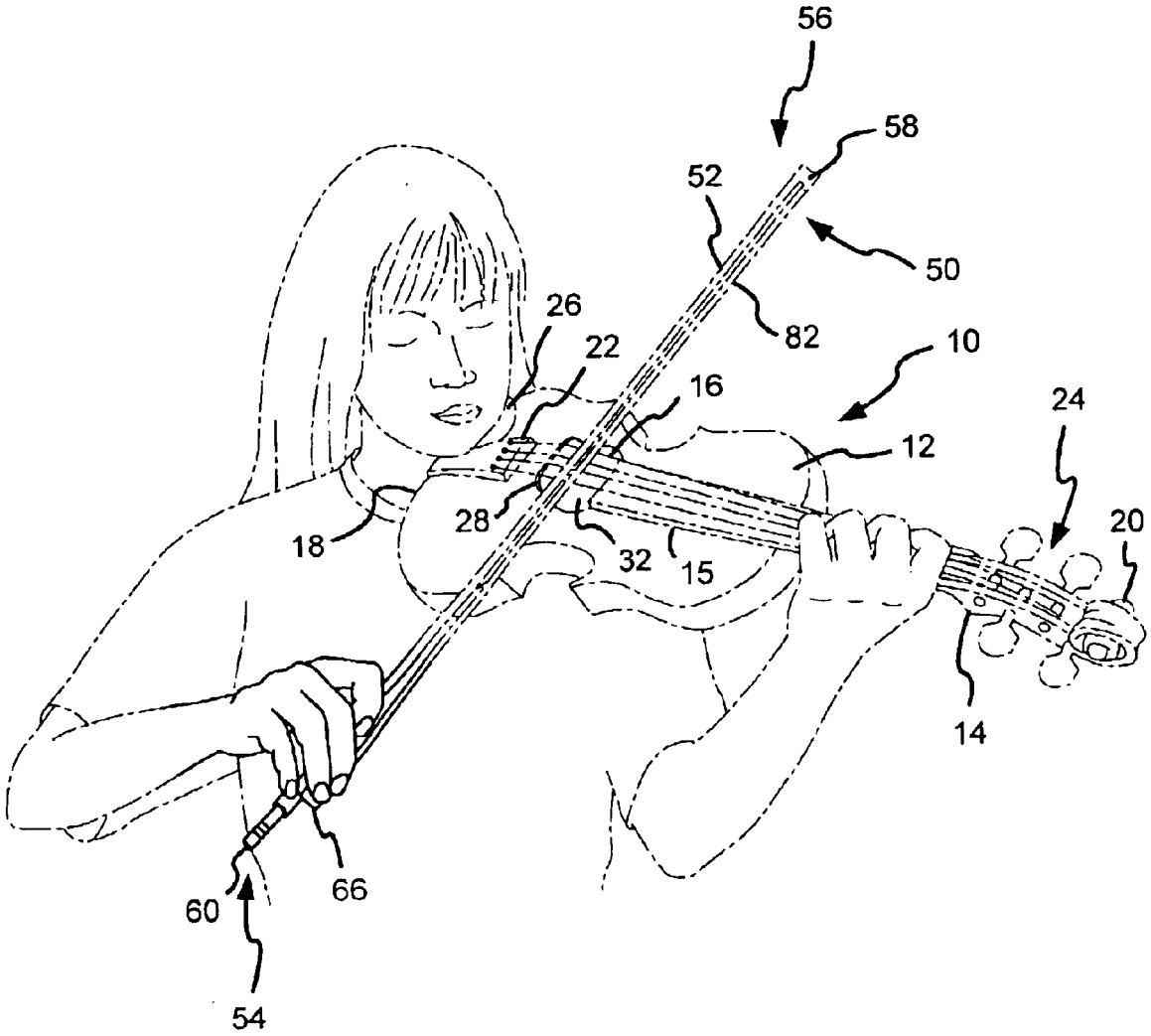
FIG. 1 shows a front perspective view of a player playing a violin using a proper grip on the bow.
Figure 2:
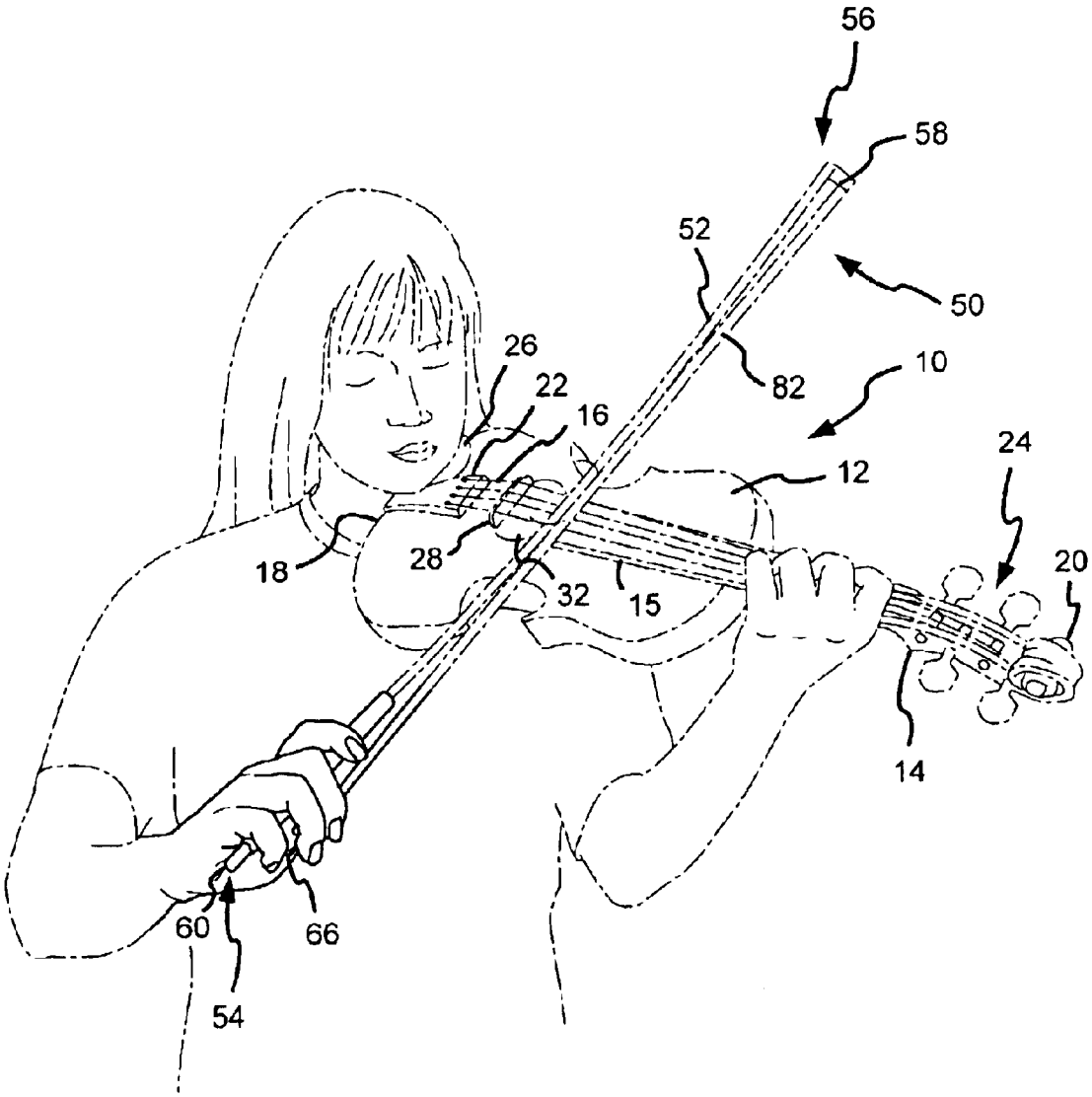
FIG. 2 shows a front perspective view of a player playing a violin using an improper grip on the bow.
Figure 3:
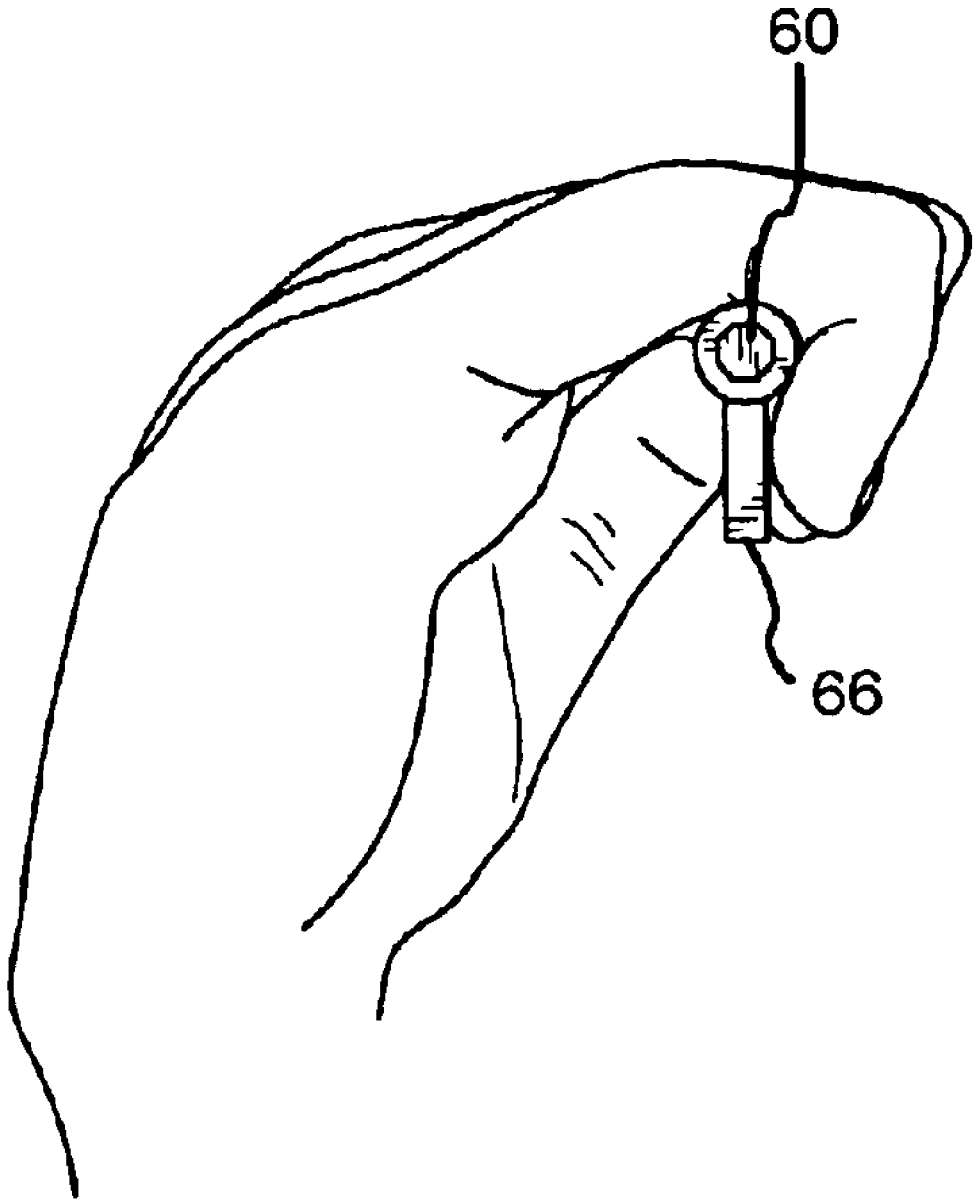
FIG. 3 shows a side perspective view of a player's right hand FIG. 2.
Figure 4:
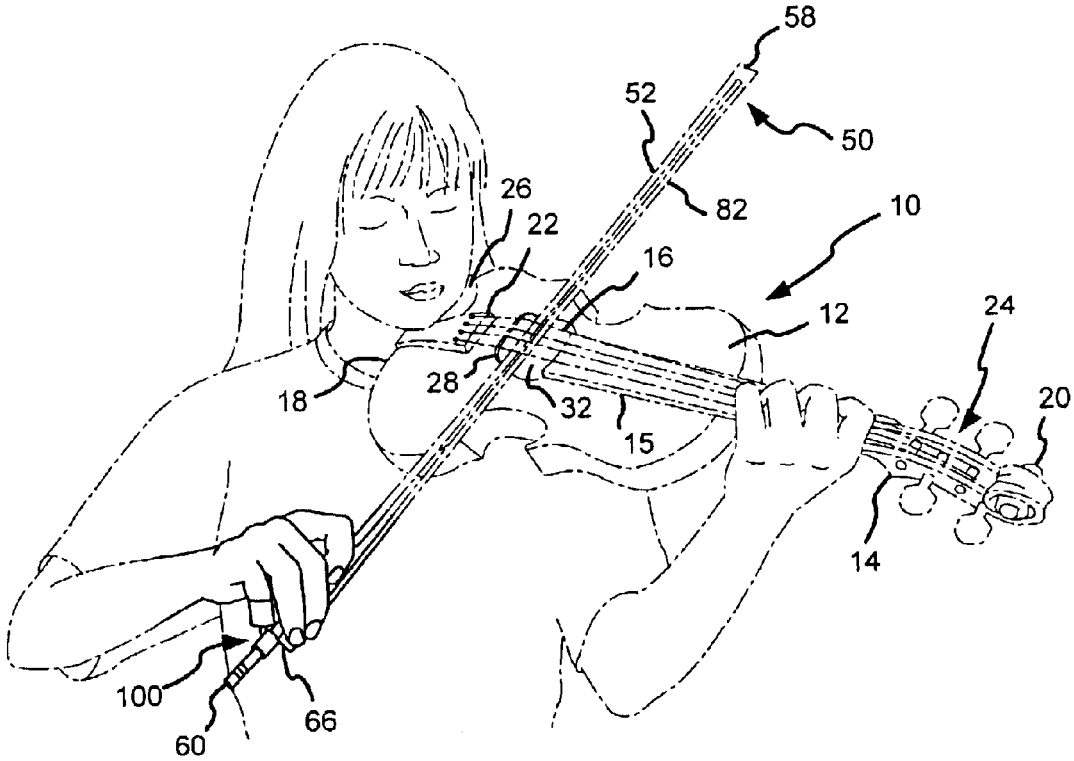
FIG. 4 shows a front perspective view of a preferred embodiment of the present invention being used by a player playing a violin.
Figure 5:
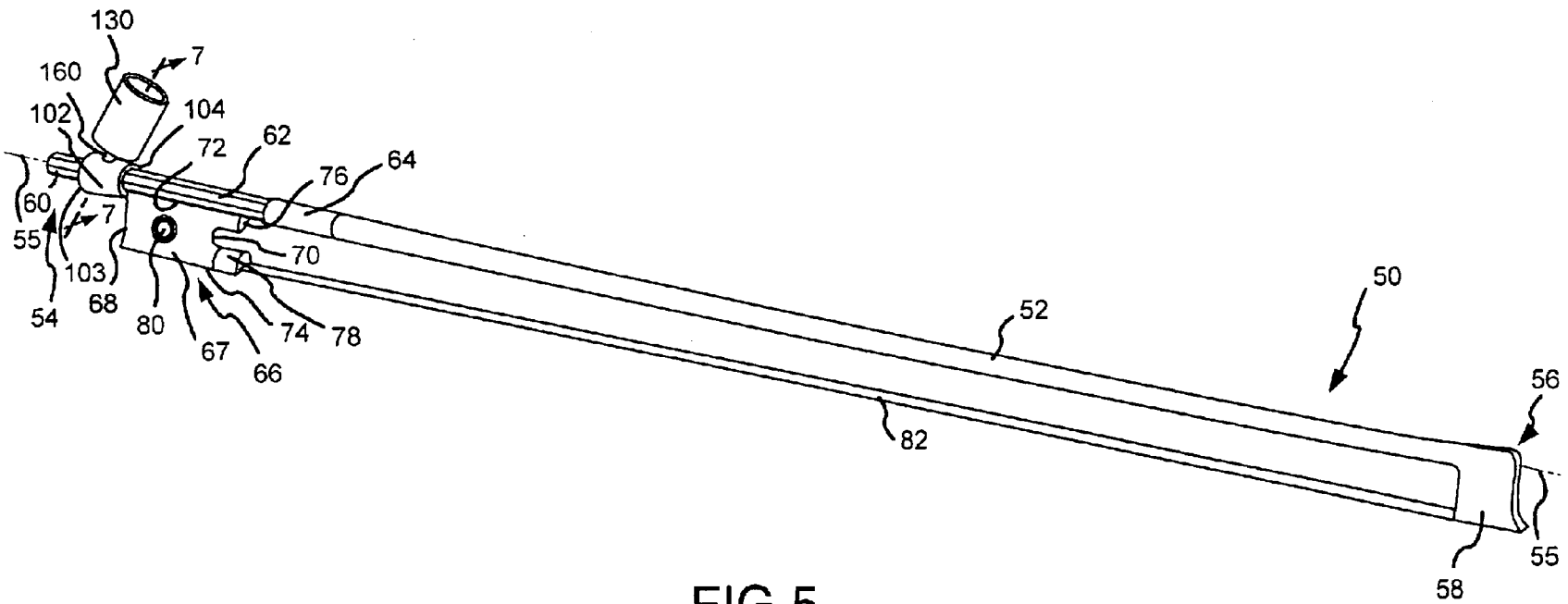
FIG. 5 shows a front plan view of the teaching device attached to the bow of FIG, 4.
Figure 6:
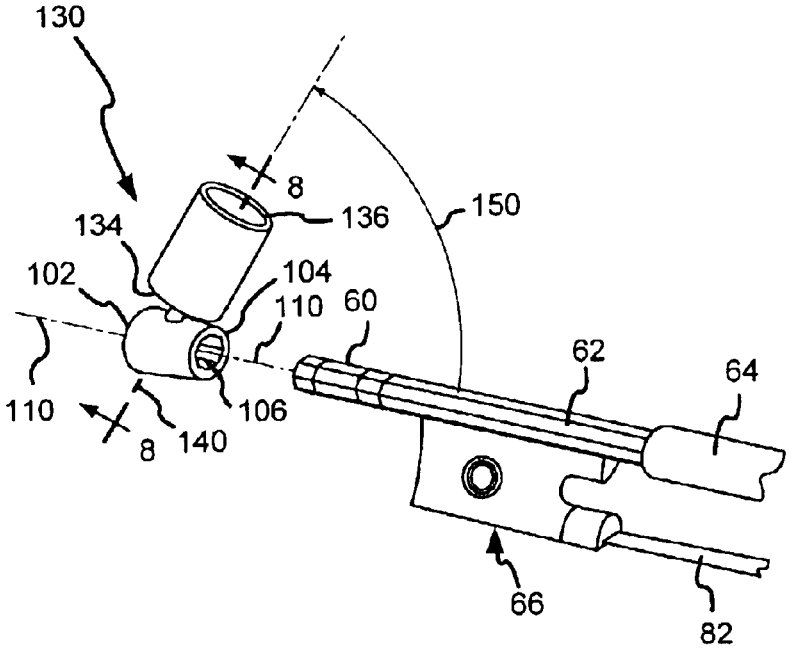
FIG. 6 shows an exploded view of the teaching device from FIG. 4.
Figure 7:
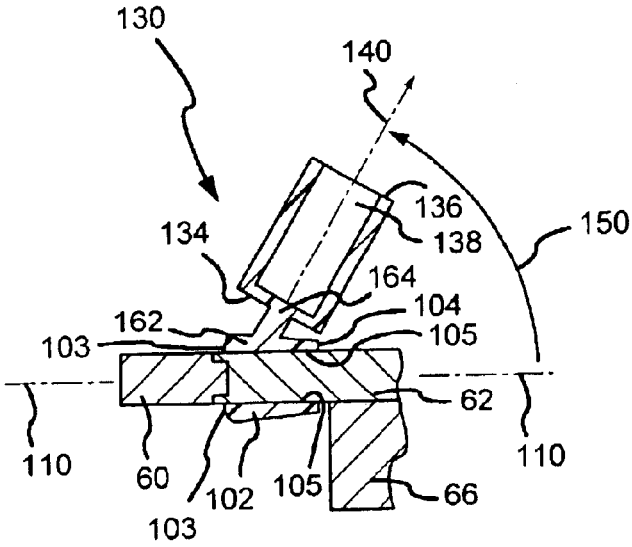
FIG. 7 shows a section view of the teaching device through line 7—7 from FIG. 5 after the device has been attached to the bow.
Figure 8:
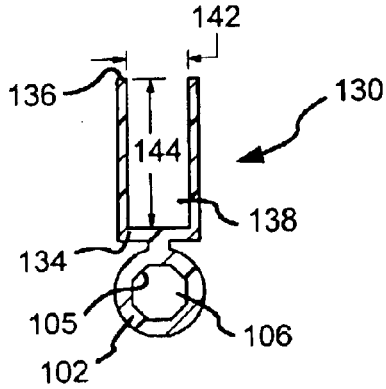
FIG. 8 shows a section view of the teaching device through line 8—8 from FIG. 6.

As shown in FIGS. 5–8, the base 102 is formed as an elongated hollow tube with a longitudinal axis 110. The tubular base 102 has an outer end 103 and an inner end 104 and an internal surface 105 therebetween that defines a central opening 106. The central opening 106 receives the bow 50 so that the longitudinal axis 110 of the base 102 is parallel to the longitudinal axis 55 of the bow 50 when the base 102 is attached to the bow 50. The central opening 106 is sized to receive the first end of the bow 50, i.e., it has a diameter only slightly larger than a diameter of the slide 62 of the bow 50 such that the internal surface 105 of the base 102 will fit snuggly around the slide 62 as shown in FIG. 7. The internal surface 105 preferably has a shape that corresponds directly to or complements the shape of the outer surface of the slide 62. So for example, if the slide 62 has an octagonal cross-sectional shape, then it is preferable for the central opening 106 to have a corresponding octagonal shape as shown in FIGS. 6 and 8. Although an octagonal shape is shown, any shape that corresponds to the shape of the bow may be utilized, including without limitation cross-sections shaped like a triangle, square, pentagon, hexagon, and the like.

The elongated hollow finger support 130 has a closed lower end 134 and an open upper end 136 defining an elongated central cavity 138 having a width 142 and a depth 144. The finger support 130 has a longitudinal axis 140 between the open end 136 and the closed end 134. The width 142 should be large enough to fit around a player's little finger and the depth 144 should be large enough to cover a portion of the little finger. The central cavity 138 preferably has a circular cross sectional shape or any other shape that fits well around a little finger.

The stem 160 has a lower end 162 and an upper end 164. The lower end 162 may be attached to or formed integrally with the base 102. The upper end 164 may be attached to or formed integrally with the closed end 134 of the finger support 130. In this way, the stem 160 connects the base 102 to the finger support 160 such that the longitudinal axis 140 of the finger support 130 is positioned at an angle 150 of less than 90° to the longitudinal axis 110 of the base 102. For example, an angle of 45° works well. The stem 160 has an axis that may be positioned parallel to the axis 140 of the finger support 130 as shown in FIG. 7, but does not have to be positioned this way so long as the axis 140 of the finger support 130 is angled as compared to the axis 110 of the base 102.

The teaching device 100 is attached to the bow 50 by sliding it over the screw 60 onto the slide 62 with the finger support 130 positioned opposite the frog 66 as shown in FIG. 6. The corresponding or complimentary shape of the slide 62 and the internal surface 105 of the base will prevent the base 102 and thus the finger support 130 from rotating about the slide 62. In this way, the teaching device 100 may be removed from the bow 50 after a player has learned how to properly grip the bow 50 and to maintain a proper grip on the bow 50.

Figure 9:
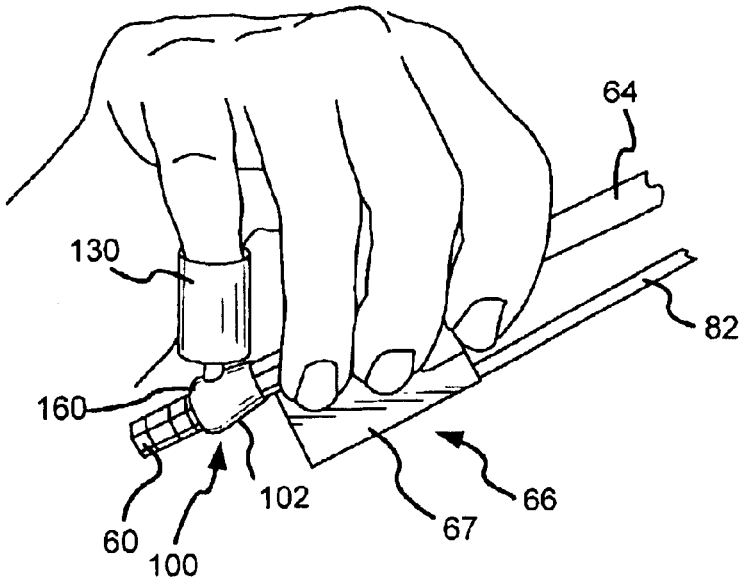
FIG. 9 shows an enlarged front view of the player's right hand from FIG. 4.
Figure 10:
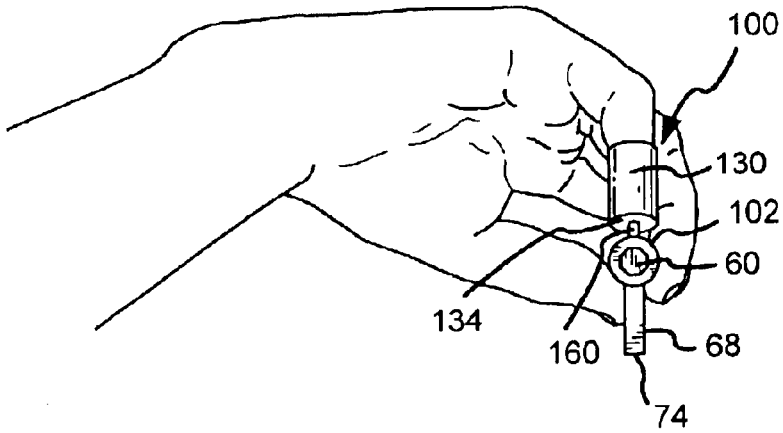
FIG. 10 shows an enlarged side view of the player's right hand from FIG. 4.

The teaching device 100 is used as shown in FIGS. 9 and 10. The player places his or her little finger in the cavity 138 of the finger support 130 after it is attached to the bow 150. The tip of the little finger rests on the closed end 134 of the finger support 130. The player places his or her middle and ring fingers on the surface 67 of the frog 66, his or her index finger on the grip 64, and his or her thumb on the opposite surface 67 of the frog 66 from the middle and ring fingers. The teaching device 100 forces the player to maintain a proper grip on the bow 50 by forcing the little finger into a proper angled position with respect to the bow 50 with the tip of the finger resting on the slide 62. With the little finger in proper position, the wrist is maintained above the frog 66, which causes the wrist to lead the bow 50 across the strings 16 of the violin 10. The larger the depth 144 of the finger support 130, the more the device 100 will restrict movement of the little finger thereby forcing the wrist above the frog 66. In this way, it very difficult for a player to lapse into an improper grip while playing with a bow 50 equipped with the teaching device 100. Further, the teaching device 100 may come with the central cavity 138 in a number of different sizes to accommodate players of all ages.

Figure 11:
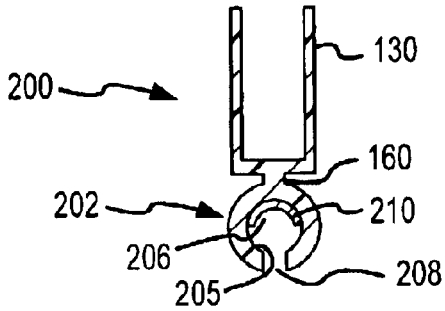
FIG. 11 shows a section view, similar to FIG. 8, of another preferred embodiment of the teaching device.

FIG. 11 shows a cross-section view of another preferred embodiment of the present invention that incorporates an alternative means for attaching a teaching device 200 to the bow 50. Specifically, the teaching device 200 has the finger support 130 connected to a base 202 by the stem 160. Similar to the base 102, the base 202 is formed as an elongated hollow tube having an outer end (not shown) and an inner end (not shown) and an internal surface 205 therebetween that defines a central opening 206. The base 202 has a longitudinal axis (not shown) similar to axis 110. The central opening 206 has a diameter only slightly larger than a diameter of the slide 62 of the bow 50 such that the internal surface 205 of the base 202 will fit snuggly around the slide 62. The internal surface 205 may have any shape, such as the circular shape shown in FIG. 11, which shape does not necessarily correspond to the shape of the bow 50. However, the base 202 further includes a longitudinal slot 208 that extends from the outer end to the inner end. The slot 208 is sized large enough to permit a portion of the bow 50, such as the slide 62, to be inserted into the opening 206 but not so large that it affects snug fit of the base 202 around the slide 62. The teaching device 200 is preferably made of a resilient material, such as plastic, that will deform slightly under pressure, but will return to its original shape once pressure is released. In this way, the base 202 of the teaching device 200 may be attached to the bow 50 by positioning the slot 208 next to the slide 62 such that the slide 62 runs parallel to and covers the slot 208 and applying a downward pressure on the base 202 thereby causing the slot 208 to expand enough to allow the slide 62 to pass through the slot 208. Once the slot 208 expands to the width of the diameter of the slide 62, it will begin to contract again and the base 202 will fit snuggly around the bow 50. Additionally, a layer of elastomeric material 210, such as closed cell foam, may be attached to the internal surface 205 to further increase the snug fit between the base 202 and the bow 50 as shown in FIG. 11. The material 210 will also use friction to prevent the teaching device 200 from rotating about the bow 50 when the player is using the bow 50.

Figure 12:
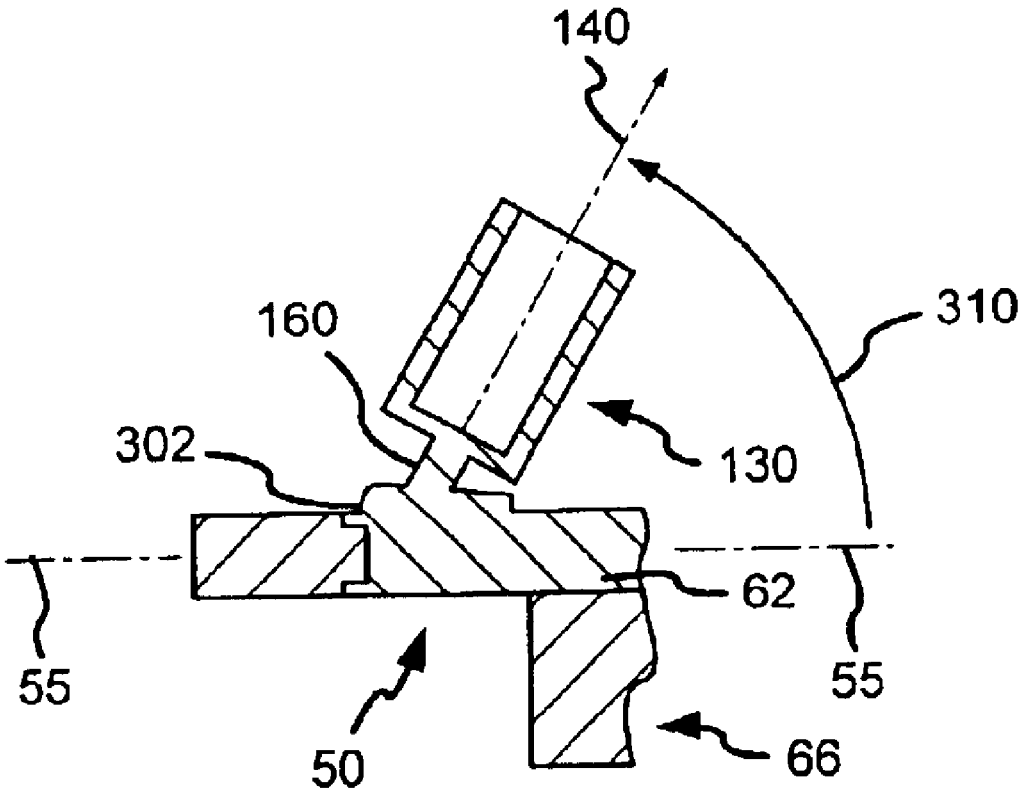
FIG. 12 is a section view, similar to FIG. 7, of another preferred embodiment of the present invention.

In yet another preferred embodiment of the present invention, a teaching device 300 may be formed integrally with a bow 50 as shown in FIG. 12. Specifically, a base 302 may be formed integrally with the slide 62 so that the finger support 130 is connected directly to and integrated with the slide 62 by the stem 160. In this way, the longitudinal axis 140 of the finger support 130 is positioned at an angle of less than 90° to the longitudinal axis 55 of the bow 50.

It will be clear that the present invention is well adapted to attain the ends and advantages mentioned as well as those inherent therein. While presently preferred embodiments have been described for purposes of this disclosure, numerous changes may be made which will readily suggest themselves to, those skilled in the art. For example, the base (102, 202, or 302) does not need to be formed integrally with the stem 160 and the finger support 160; instead these three parts may be attached or connected using alternative connection means. Further, the finger support 130 may be made of a different material than the base (102, 202, or 302). Accordingly, all such modifications, changes and alternatives are encompassed in the spirit of the invention disclosed and as defined in the appended claims.

What is claimed is:

1. A teaching device for a string instrument designed to be played with a bow, the teaching device comprising:

a hollow tubular base having a longitudinal axis and an outer end and an inner end and an internal surface therebetween defining a central opening;

a finger support having a closed lower end and an open upper end and a longitudinal axis; and a stem connecting the base to the finger support such that the longitudinal axis of the base is positioned at an angle of less than 90° to the longitudinal axis of the finger support.

2. The teaching device of claim 1 wherein the stem is connected to the closed end of the finger support.

3. The teaching device of claim 2 wherein the stem has an axis parallel to the longitudinal axis of the finger support.

4. The teaching device of claim 1 wherein the central opening of the base is sized to receive an end of the bow.

5. The teaching device of claim 1 wherein the base has an internal shape complimentary to a shape of an outer surface of the one end of the bow.

6. The teaching device of claim 5 wherein the internal shape of the base is octagonal.

7. The teaching device of claim 1 wherein the internal shape of the base is circular.

8. The teaching device of claim 1 wherein the base further includes a longitudinal slot that extends from the outer end to the inner end of the base.

9. The teaching device of claim 8 wherein the slot is sized to permit the bow to be inserted into the central opening through the slot.

10. The teaching device of claim 8 wherein the base is made of a resilient material that will deform slightly under pressure, but will return to its original shape once pressure is released.

11. The teaching device of claim 10 wherein the material is plastic.

12. The teaching device of claim 8 further comprising a layer of elastomeric material attached to the internal surface of the base.

13. The teaching device of claim 12 wherein the elastomeric material is a closed cell foam.

14. The teaching device of claim 1 wherein the base is formed integrally with the stem and the finger support.

15. The teaching device of claim 1 wherein the central cavity of the finger support has a circular cross-sectional shape.

16. The teaching device of claim 1 wherein the angle is substantially 45°.

17. A teaching device for a bowed string instrument comprising:

a bow having a first end and a second end defining a longitudinal axis therebetween;

a base connected to the bow;

a finger support having closed lower end and an open upper end and a longitudinal axis; and a stem connecting the base to the finger support such that the longitudinal axis of the finger support is positioned at an angle of less than 90° to the longitudinal axis of the bow.

18. The teaching device of claim 17 wherein the base is formed integrally with the bow.

19. The teaching device of claim 17 wherein the bow further comprises:

a screw attached to the first end of the bow and a tip formed at the second end of the bow, wherein the base is connected to the bow near the first end of the bow.

20. The teaching device of claim 17 wherein the stem has an axis parallel to the longitudinal axis of the finger support.

21. The teaching device of claim 17 wherein the angle is substantially 45°.

* * * * *